United States Patent [19]

Holt

[11] 4,334,353

[45] Jun. 15, 1982

[54] APPARATUS FOR ASSEMBLING ELECTRICAL CABLES TO ELECTRICAL CONNECTORS

[75] Inventor: Harley R. Holt, Forest Park, Ill.

[73] Assignee: Bunker Ramo Corporation, Oak Brook, Ill.

[21] Appl. No.: 130,295

[22] Filed: Mar. 14, 1980

[51] Int. Cl.[3] ..... H01R 43/04

[52] U.S. Cl. ..... 29/753; 29/761; 72/452

[58] Field of Search ..... 29/749–753, 29/760, 761, 566.3, 566.4; 72/452, 407, 409, 410; 269/107, 236–239

[56] References Cited

U.S. PATENT DOCUMENTS

| | | | |
|---|---|---|---|
| 513,516 | 1/1894 | Lemp et al. | 72/452 X |
| 1,090,575 | 3/1914 | Shannon | 269/238 X |
| 2,294,685 | 9/1942 | Nelson | 72/104 |
| 4,085,497 | 4/1978 | Nijman et al. | 29/749 X |
| 4,193,187 | 3/1980 | Haller et al. | 29/749 |

*Primary Examiner*—Carl E. Hall

*Attorney, Agent, or Firm*—Nicholas A. Camasto; John R. Hoffman

[57] ABSTRACT

A hand operated tool for assembling electrical cables to an electrical connector which has a cable clamp for clamping a cable in position for termination with conductive contact means on the connector. A connector is properly located in position for receiving an electrical cable, and a pair of jaw members is mounted on the apparatus for movement in a transverse direction toward and away from the connector to engage and crimp the cable clamp onto the cable and provide strain relief therefor. A single hand lever is mounted for pivotal movement in a front-to-rear direction generally perpendicular to the direction of movement of the jaw members. A motion transmitting mechanism is operatively associated between the hand lever and the jaw members for moving the jaw members in response to pivotal movement of the hand lever. The motion transmitting mechanism includes a cam member, having a cam ramp, fixed to the inner end of the hand lever, and a roller-type cam follower operatively associated with one of the clamping jaw members. The jaw members are interconnected by gear segments for conjoint movement thereof in unison toward and away from the connector and its cable clamp.

16 Claims, 7 Drawing Figures

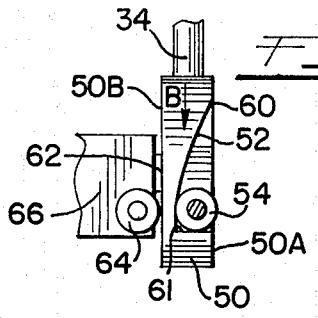
FIG. 6
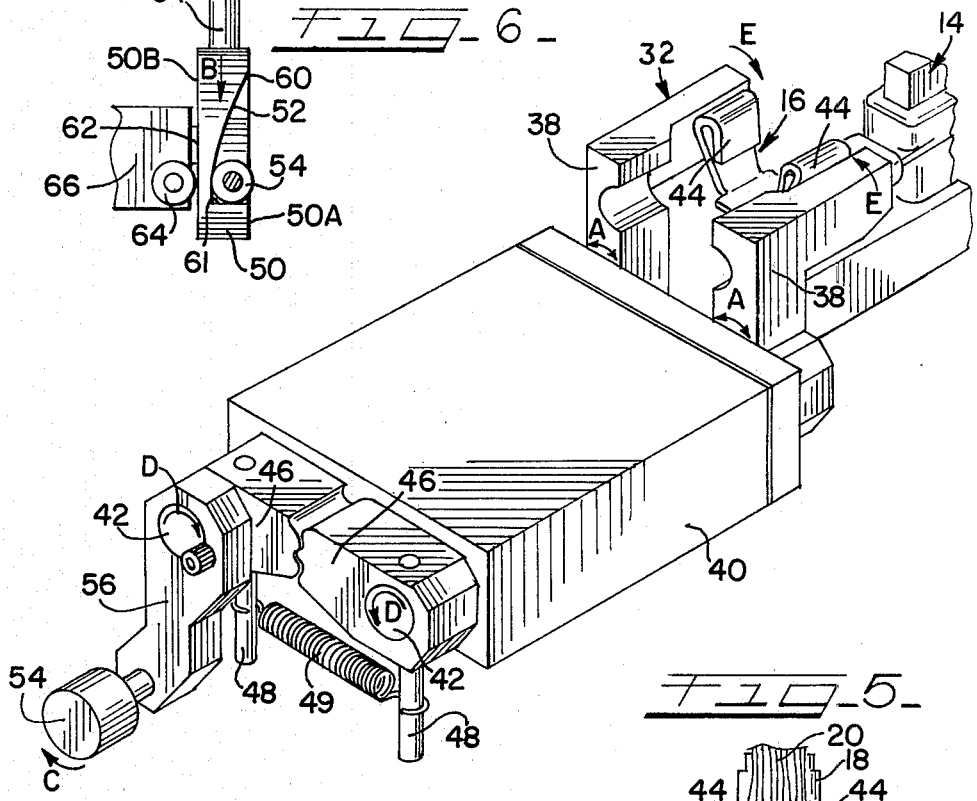
FIG. 3
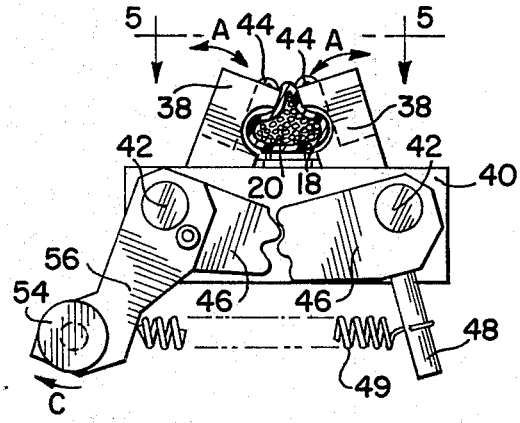
FIG. 4
FIG. 5
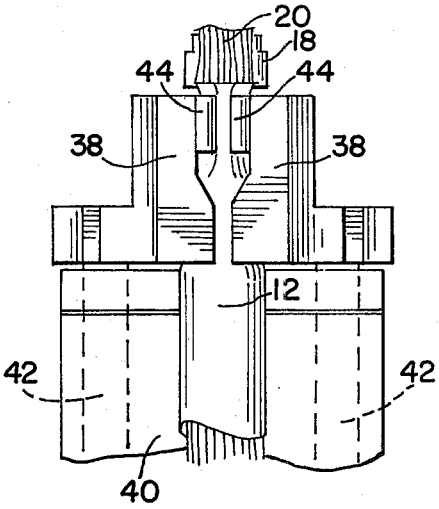
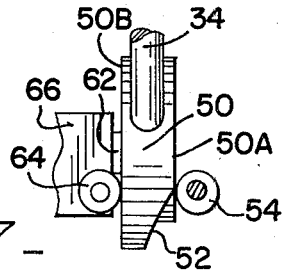
FIG. 7

APPARATUS FOR ASSEMBLING ELECTRICAL CABLES TO ELECTRICAL CONNECTORS

BACKGROUND OF THE INVENTION

This invention is directed to an apparatus which, as disclosed herein, comprises a hand operated tool for assembling electrical cables, or the like, to an electrical connector. More particularly, the exemplary embodiment of the invention is directed to an apparatus for crimping a cable clamp means, hereinafter sometimes referred to as clamp, onto a cable in position for termination with conductive contact means, sometimes referred to herein as contacts, on the connector, the cable clamp means being associated with the connector itself.

In the electrical industry, particularly in such fields as telecommunications or the like, a continuing problem is to provide tools or apparatus for simply performing various operations on electrical wires or cables, such as connecting, terminating or crimping the wires or cables to electrical connectors or terminals, and for otherwise handling the wires in a simple and efficient manner during volume manufacturing. This is particularly true for multiconductor cables which have numerous individual wires for termination to plural contacts of an electrical connector. For instance, with such connectors as the Amphenol Series 57 and 157 electrical connectors, an elongated connector body is provided with receptacle means including a plurality of linearly oriented slots or notches which are adapted for receiving individual contacts. The contacts may be capable of being soldered, insulation pierced or crimped to the individual wires of an electrical cable depending on their design. Considerable manipulation of the numerous individual wires is required, and often means is provided on the assembly tool itself for clamping or holding the cable while the individual wires are terminated to the connector contacts.

Certain connectors of the character described are provided with a cable clamp means which forms a part of the connector itself and which is utilized to clamp onto the outer covering of the cable and provide a strain relief therefor.

Accordingly, the present invention is directed to providing an apparatus for performing an assembly operation between an electrical cable, or the like, and an electrical connector, such as crimping or clamping the cable clamp means of the connector onto a cable while the connector is properly located in position in the assembly machine.

An object, therefore, of the present invention is to provide a new and improved apparatus for assembling electrical cables, or the like, to an electrical connector.

A further object of the invention is to provide an apparatus for assembling electrical cables to an electrical connector which has cable clamp means for clamping a cable in position for termination with conductive contact means on the connector.

Still a further object of the invention is to provide a novel apparatus for assembling electrical cables to electrical connectors, including means for crimping a cable clamp portion of the connector onto a cable to provide strain relief therefor.

SUMMARY OF THE INVENTION

More particularly, in the exemplary embodiment of the invention, the apparatus includes a base having locator means for properly locating a connector in position for receiving an electrical cable. The locator means comprises a forward assembly station of the machine whereat an operator can manipulate the individual wires of a multi-conductor cable for termination to the individual contacts of a multi-contact connector.

Jaw means is mounted on the base for movement in a generally transverse or side-to-side direction toward and away from a properly positioned connector to engage the cable clamp means thereof for clamping or crimping onto a cable and provide strain relief therefor. In particular, the jaw means includes a pair of opposed jaw members mounted on generally parallel front-to-rear pivot axes, for pivotal movement into and out of engagement with the cable clamp means of the connector. The jaw members are interconnected by means of a pair of intermeshed gear segments for conjoint pivotal movement of the jaw members in unison toward and away from the cable clamp means.

An actuator member in the form of a single hand lever is mounted on the base of the apparatus for pivotal movement in a plane generally parallel to the pivot axes of the jaw members, i.e. the pivot axis of the hand lever is generally perpendicular to the pivot axes of the jaw members.

Motion transmitting means is operatively associated between the hand lever and the jaw members for moving the jaw members in opposite directions in response to pivotal movement of the single hand lever. More particularly, the motion transmitting means referred to above includes a cam member connected to the inner end of the hand lever for rotational movement therewith, and a cam follower in the form of a roller member engageable with the cam member and connected to one of the gear segments of the jaw members for rotation thereof in response to pivotal movement of the hand lever. The cam member has a cam ramp or track engageable with the cam follower roller, and a generally flat land on the cam member extends generally perpendicular to the pivot axis thereof, terminating the cam ramp and providing a lost motion means for the cam follower roller. This lost motion means prevents the lever member from moving the jaw members beyond a predetermined angle, thereby preventing excessive crimping of the cable clamp means onto the cable to avoid possible damage to the individual conductors of the cable. This structure therefore also provides a tactile indication to the operator.

The cam ramp of the motion transmitting cam member faces axially in one direction relative to the pivot axis of the hand lever, and a second roller member is mounted on the base and is engageable with a side of the cam member opposite the cam ramp. The cam member is thus sandwiched between the roller members. The cam member is rotatably mounted on a shaft means for free movement between the roller members to prevent binding thereof.

Other objects, features and advantages of the invention will be apparent from the following detailed description taken in connection with the accompanying drawings.

DESCRIPTION OF THE DRAWINGS

FIG. 3 is a perspective view, on a further enlarged scale, as viewed from the rear of the cable clamping jaws and interconnecting gear segments shown in FIG. 2;

FIG. 4 is a rear elevational view of the components shown in FIG. 3;

FIG. 5 is a fragmentary top plan view showing the cable clamping jaw members of the present invention, in their closed position, as looking downwardly in the direction of line 5—5 of FIG. 4;

FIG. 6 is a front elevational view showing the cam means and roller members of the present invention, with the cam follower roller in engagement with the cam track; and FIG. 7 is a view similar to that of FIG. 6, with the cam follower roller in engagement with the flat land of the cam member.

DETAILED DESCRIPTION OF THE INVENTION

Figures 1, 2:
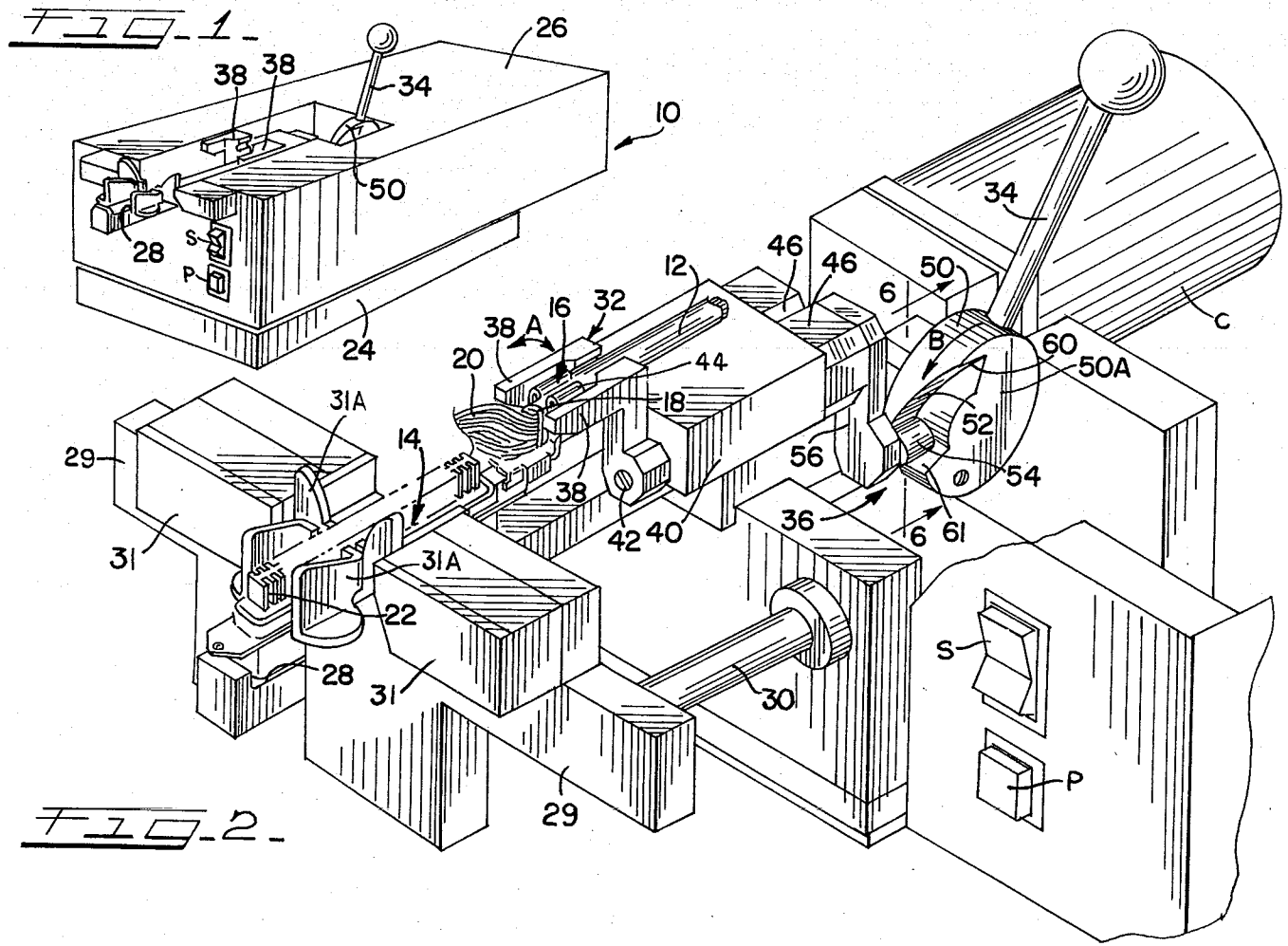
FIG. 1 is a perspective view of an apparatus for assembling electrical cables, or the like, to an electrical connector, embodying the concepts of the present invention.
FIG. 2 is a perspective view, on an enlarged scale, of the apparatus of FIG. 1, with the cover thereof removed to illustrate interior components of the apparatus.

Referring to the drawings in greater detail, and first to FIGS. 1 and 2, an apparatus, generally designated 10, is designed for assembling electrical cables 12, or the like, to an electrical connector, generally designated 14, which has a cable clamp means, generally designated 16, for clamping cable 12 in position for termination with conductive contact means on the connector. In particular, the cable has an outer cladding or covering 18 surrounding a plurality of wires or conductors 20 which are terminated to individual contacts (not shown) which normally are positioned within slots 22 of the connector.

Apparatus 10 has a base 24 and an outside cover 26 which houses most of the operative interior components of the invention. It should be pointed out at the outset, that, as used herein, the terms "base" or "base portion" used in the claims and description of the invention are intended to encompass various fixed structural elements of the apparatus, but which do not perform specific operative functions of the invention.

The apparatus includes locator means 28 which defines a forward assembly station at the front of the apparatus to form a receptacle for connector 14. It should be pointed out that the invention is shown herein as employed in an automatic terminating apparatus, but many other applications can be made of the invention within the scope contemplated, such as a simple bench press application. Suffice it to say, in the automatic terminating apparatus shown herein, a carriage frame 29 is mounted on shafts 30 and is moved in a front-to-rear direction by an electric motor, an air cylinder or other actuator "C", along the length of locator means 28 and connector 14. Insertion heads 31 are mounted on the carriage frame, and insertion punches 31A are provided for inserting conductors 20 into the slots of connector 14. A switch "S" and pilot light "P" are shown on the front of cover 26. Other details of structure and operation of a similar automatic insertion apparatus can be seen in U.S. Pat. No. 3,967,356 to the inventor of the present invention, and which is incorporated herein by reference.

The operative components of the present invention include jaw means, generally designated 32, a hand lever 34, and motion transmitting means, generally designated 36, operatively associated between the hand lever and the jaw means for moving the jaw means in a given direction (described hereinafter) in response to movement of the hand lever. More particularly, and referring additionally to FIGS. 3–5, jaw means 32 includes a pair of opposed jaw members 38 which are pivoted to a base 40 for movement in a transverse or side-to-side direction as indicated by the double headed arrows A in FIGS. 2–4. The jaw members are pivoted to base portion 40 on generally parallel pivot axes defined by pivot shafts 42 which extend front-to-rear of the apparatus through base portion 40.

FIG. 3 shows jaw members 38 in open positions, with ears 44 of the cable clamp means spread apart for receiving cable 12 therebetween. FIGS. 4 and 5 show the jaw members in their closed positions clamping or crimping ears 44 of the cable clamp means onto cable 12 (which includes covering 18 and conductors 20).

Means is provided for interconnecting jaw members 38 for conjoint movement thereof in unison toward and away from cable clamp ears 44. More particularly, pivot shafts 42 for jaw members 38 have intermeshed gear segments 46 fixed to the inner ends of the shafts. Projecting rods 48 extend downwardly from gear segments 46, and a coil spring 49 interconnects rods 48 so as to bias jaw members 38, through gear segments 46, toward their open or spread positions shown in FIG. 3.

The motion transmitting means operatively associated between hand lever 34 and jaw members 38 for moving the jaw members in response to pivotal movement of the hand lever, is best shown in FIGS. 2, 6 and 7. More particularly, motion transmitting means 36 includes a cam member 50 fixed to the lower or inner end of hand lever 34 for rotational movement therewith. The cam member includes a cam ramp or track 52 cut into the side and periphery of the cam member. A cam follower in the form of a roller member 54 is rotatably mounted on the rear face of an extension member 56 which extends downwardly from one of the gear segments 46. Since intermeshed gear segments 46 conjointly pivot jaw members 38, movement of the single cam follower roller 54 along cam track 52 effects conjoint but opposite movement of opposed jaw members 38.

Thus, it can be seen that pivotal movement of hand lever 34 in the direction of arrow B in FIGS. 2 and 6 causes movement of cam follower roller 54 arcuately outwardly in the direction of arrows C (FIGS. 3 and 4). This outward movement of the cam follower roller causes gear segments 46 to rotate in the direction of arrows D (FIG. 3) which, in turn, causes jaw members 38 to move inwardly in the direction of arrows E (FIG. 3) from their open or spread positions to their closed positions.

Lost motion means is provided to prevent hand lever 34 from moving jaw members 38 beyond a predetermined angle of pivotal movement thereof. More particularly, an outer face 50A of cam member 50 is generally flat to form a land portion which intersects cam ramp 52 at line 60. Therefore, cam follower roller 54 rides upwardly and outwardly along cam ramp 52 until it reaches line 60, whereupon the roller simply will ride onto face 50A of the cam member, and the cam roller no longer moves outwardly in the direction of arrow C (FIG. 3) to effect further spreading of jaw members 38.

A stop surface 61 is defined at the inner end of cam ramp 52 on cam member 50 to define the outer spreading limit of jaws 38.

Cam member 50 is freely rotatable on a shaft means 62. A backup roller member 64 is rotatably mounted on a base portion 66 of the apparatus. It is engageable with a side 50B of cam member 50 opposite cam ramp 52 and sandwiches the cam member between roller members 50 and 64. With this structural combination, cam member 50, being rotatably mounted on shaft means 62, is provided with free movement between roller members 50 and 64 to prevent any binding of the camming mechanism of the invention.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. Apparatus for assembling electrical cables, or the like, to an electrical connector which has cable clamp means for clamping a cable in position with its conductors terminated to contact means on the connector, comprising:

a base having locator means for properly locating a connector in position for receiving an electrical cable;

a pair of jaw members mounted on said base for movement in a given direction toward and away from a properly positioned connector to engage said cable clamp means for clamping a cable to provide strain relief therefor;

an actuator member mounted on said base for moving said jaw members;

motion transmitting means operatively associated between said actuator member and only one of said jaw members for moving said one jaw member in response to movement of said actuator member; and means interconnecting said jaw members for conjoint movement thereof in unison toward and away from said cable clamp means in response to movement of said actuator member.

2. The apparatus of claim 1 wherein said actuator member includes a lever member pivotally mounted on said base for movement about a pivot axis generally parallel to said given direction of movement of said jaw members.

3. The apparatus of claim 1 wherein said interconnecting means comprises a pair of intermeshed gear segments operatively connected to said jaw members.

4. The apparatus of claim 3 wherein said actuator member includes a lever member pivotally mounted on said base for movement about a pivot axis generally perpendicular to the pivot axes of said jaw members.

5. The apparatus of claim 4 wherein said motion transmitting means includes lost motion means to prevent said lever member from moving said jaw members beyond a predetermined angle of pivotal movement thereof notwithstanding continued pivotal movement of said lever member.

6. The apparatus of claim 4 wherein said motion transmitting means includes a cam member connected to said lever member for rotational movement therewith, and a cam follower engageable with said cam member and connected to the gear segment of said one jaw member for rotation thereof in response to pivoting said lever member.

7. The apparatus of claim 6 wherein said cam member includes a cam ramp engageable with said cam follower and lost motion means comprising a generally flat land portion terminating said cam ramp.

8. The apparatus of claim 1 wherein said motion transmitting means includes lost motion means to prevent said actuator member from moving said jaw members beyond a predetermined extent of movement thereof notwithstanding continued movement of said actuator member.

9. The apparatus of claim 1 wherein said actuating member includes a lever member pivotally mounted on said base for movement about a pivot axis generally parallel to said given direction of movement of said jaw members, said motion transmitting means including a cam member connected to said lever member for rotational movement therewith, said cam member having a cam track facing axially in one direction relative to the pivot axis of said lever member, and a cam follower in the form of a roller engageable with said cam track and connected to said one jaw member for moving both jaw members in response to rotation of the cam member.

10. The apparatus of claim 9 including a second roller member mounted on said base and engageable with a side of said cam member facing opposite said cam track so as to sandwich the cam member between said roller members.

11. The apparatus of claim 10 wherein said cam member is rotatably mounted on a shaft means for free movement between said roller members to prevent binding thereof.

12. The apparatus of claim 9 wherein said cam member includes a generally flat land portion extending generally perpendicular to the axis of rotation thereof and terminating said cam track to provide lost motion means to prevent said lever member from moving said jaw means after a predetermined pivotal movement thereof and rotational movement of said cam member.

13. Apparatus for assembling electrical cables, or the like, to electrical connectors, comprising:

a base having means defining a forward assembly station including locating means for properly locating a connector in position for receiving an electrical cable;

a single hand lever pivotally mounted on said base adjacent said forward assembly station for pivotal movement in a front-to-rear direction;

a pair of jaw members mounted on said base for movement toward and away from said assembly station in a transverse direction generally perpendicular to the direction of pivotal movement of said hand lever for clamping a portion of a connector located at the assembly station;

motion transmitting means operatively associated between said hand lever and only one of said jaw members for operating said one jaw member in response to pivotal movement of said hand lever; and means interconnecting said jaw members for conjoint movement thereof in unison toward and away from said assembly station in response to pivotal movement of said single hand lever.

14. The apparatus of claim 13 wherein said jaw members are adapted for crimping a cable clamp portion of an electrical connector onto an electrical cable.

15. The apparatus of claim 13 wherein said interconnecting means comprises a pair of intermeshed gear segments operatively connected to said jaw means.

16. The apparatus of claim 13 wherein said motion transmitting means includes lost motion means to prevent said hand lever from moving said jaw members after a predetermined angle of pivotal movement thereof.

* * * * *